US005492334A

United States Patent [19]

Carignan et al.

[11] Patent Number: 5,492,334

[45] Date of Patent: Feb. 20, 1996

[54] HAND-HELD BALL GAME TOY

[76] Inventors: Robert L. Carignan, 7 Ivy Lollow Ct., Cranston, R.I. 02921; Ting Liu, 1006 Chelsea Pl., Matthews, N.C. 28105

[21] Appl. No.: 406,459

[22] Filed: Mar. 20, 1995

[51] Int. Cl.[6] ..... A63F 7/20

[52] U.S. Cl. ..... 273/399; 273/85 E

[58] Field of Search ..... 273/399, 1.5 R, 273/85 R, 85 E, 328, 324, 357, 355, 356

[56] References Cited

U.S. PATENT DOCUMENTS

| | | | |
|---|---|---|---|
| 286,868 | 10/1883 | Thompson | 273/328 X |
| 1,927,067 | 9/1933 | Manassero | 273/399 |
| 2,165,914 | 7/1939 | Batkin | 273/324 |
| 3,074,720 | 1/1963 | Carver et al. | 273/85 E |
| 3,297,325 | 10/1967 | Lerner et al. | 273/399 |
| 3,834,701 | 9/1974 | Hashimoto | 273/357 X |
| 4,025,074 | 5/1977 | Hodges | 273/85 E |
| 5,294,913 | 3/1994 | Mower et al. | 273/1.5 R X |

FOREIGN PATENT DOCUMENTS

| | | | |
|---|---|---|---|
| 505477 | 12/1954 | Italy | 273/357 |

OTHER PUBLICATIONS

Hong Kong Toys 1977, Feb. 1977, Hong Kong Ping Pong.

*Primary Examiner*—Paul E. Shapiro

[57] ABSTRACT

A hand-held ball game toy including a column upright stanchion for the holding of the hand; a housing supported on the column upright stanchion, having a vertical back wall and a goal mounted on the vertical back wall; a trigger mounted on the column upright stanchion; a ball received inside the housing; a serving unit mounted inside the housing below the goal and driven by the trigger to eject the ball toward the goal; a scoring unit mounted on the vertical back wall of the housing and triggered by the ball to score points when the ball is driven into the goal; and a shot timer unit mounted on the vertical back wall of the housing and controlled to count down a predetermined length of time.

5 Claims, 5 Drawing Sheets

HAND-HELD BALL GAME TOY

BACKGROUND OF THE INVENTION

The present invention relates to a hand-held ball game toy which uses a trigger to drive a serving unit causing it to eject a ball toward a goal, and a rocker arm actuated scoring unit to score points.

A variety of ball game toys have been disclosed, and have appeared on the market. These ball game toys are commonly heavy and need much playing space. Therefore, they cannot be carried with oneself for playing at any place. Furthermore, these ball game toys have no scoring means to automatically score the points. There are also commercially available TV game machines for playing a variety of ball games. However, these TV game machines are commonly expensive and difficult to maintain. Furthermore, a TV game machine can be operated only when power supply is available.

SUMMARY OF THE INVENTION

It is one object of the present invention to provide a hand-held ball game toy which is can be held in the hand for playing a ball game personally. It is another object of the present invention to provide a hand-held ball game toy which allows the player to shoot the ball in different directions. It is another object of the present invention to provide a hand-held game toy which does not consume electric power supply. It is still another object of the present invention to provide a hand-held ball game toy which can automatically score the points. It is still another object of the present invention to provide a hand-held ball game toy which simple in structure. It is still another object of the present invention to provide a hand-held ball game toy which is inexpensive to manufacture and easy to maintain. To achieve the aforesaid objects, there is provided a hand-held ball game toy comprised of: a column upright stanchion for the holding of the hand; a housing supported on the column upright stanchion, having a vertical back wall and a goal mounted on the vertical back wall; a trigger mounted on the column upright stanchion; a ball received inside the housing; a serving unit mounted inside the housing below the goal and driven by the trigger to eject the ball toward the goal; a scoring unit mounted on the vertical back wall of the housing and triggered by the ball to score points when the ball is driven into the goal; and a shot timer unit mounted on the vertical back wall of the housing and controlled to count down a predetermined length of time.

DETAILED DESCRIPTION OF THE PREFERRED EMBODIMENT

Figure 1:
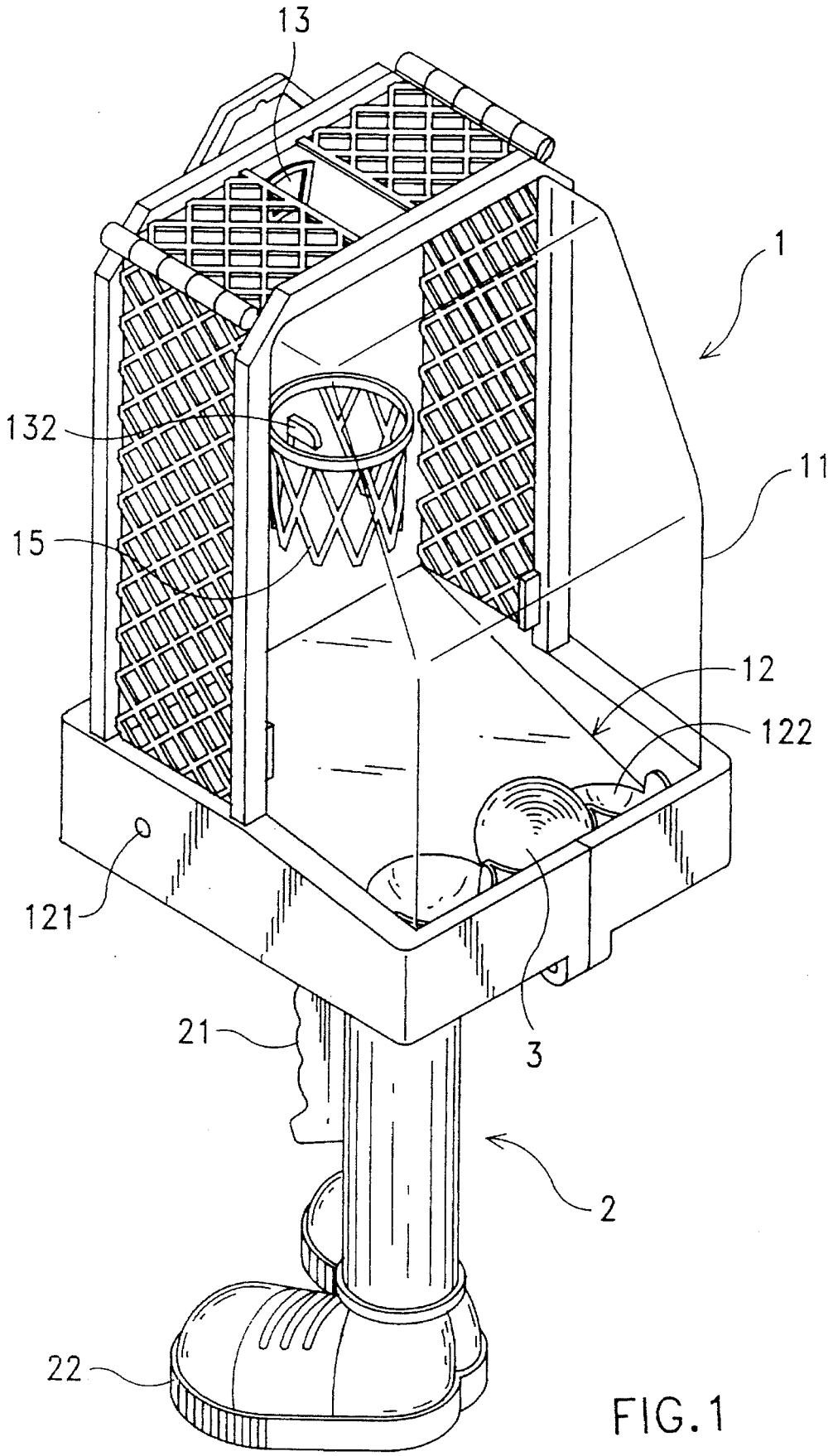
FIG. 1 is a front elevational view of a hand-held ball game toy according to the present invention.

Referring to FIG. 1, a hand-held ball game toy in accordance with the present invention is generally comprised of a mainframe 1, and a column upright stanchion 2.

Figure 1C:
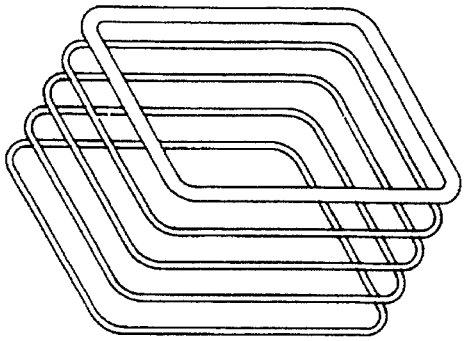
FIGS. 1A, 1B, 1C show different forms of the goal according to the present invention.
Figure 1B:
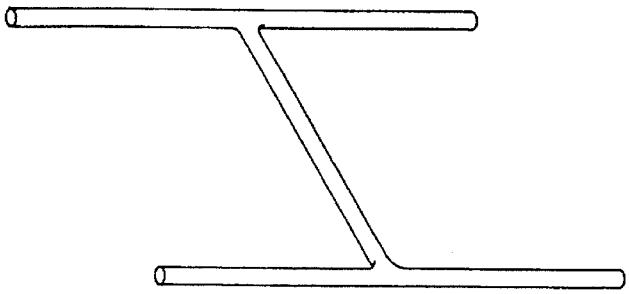
Figure 1A:
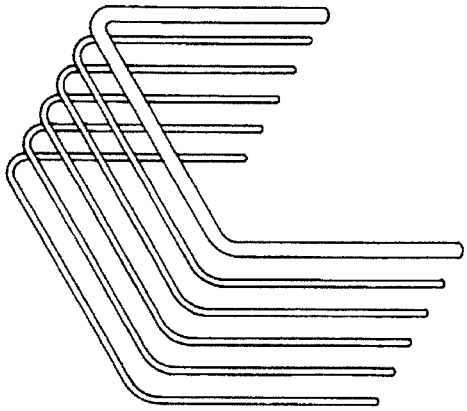
Figure 2:
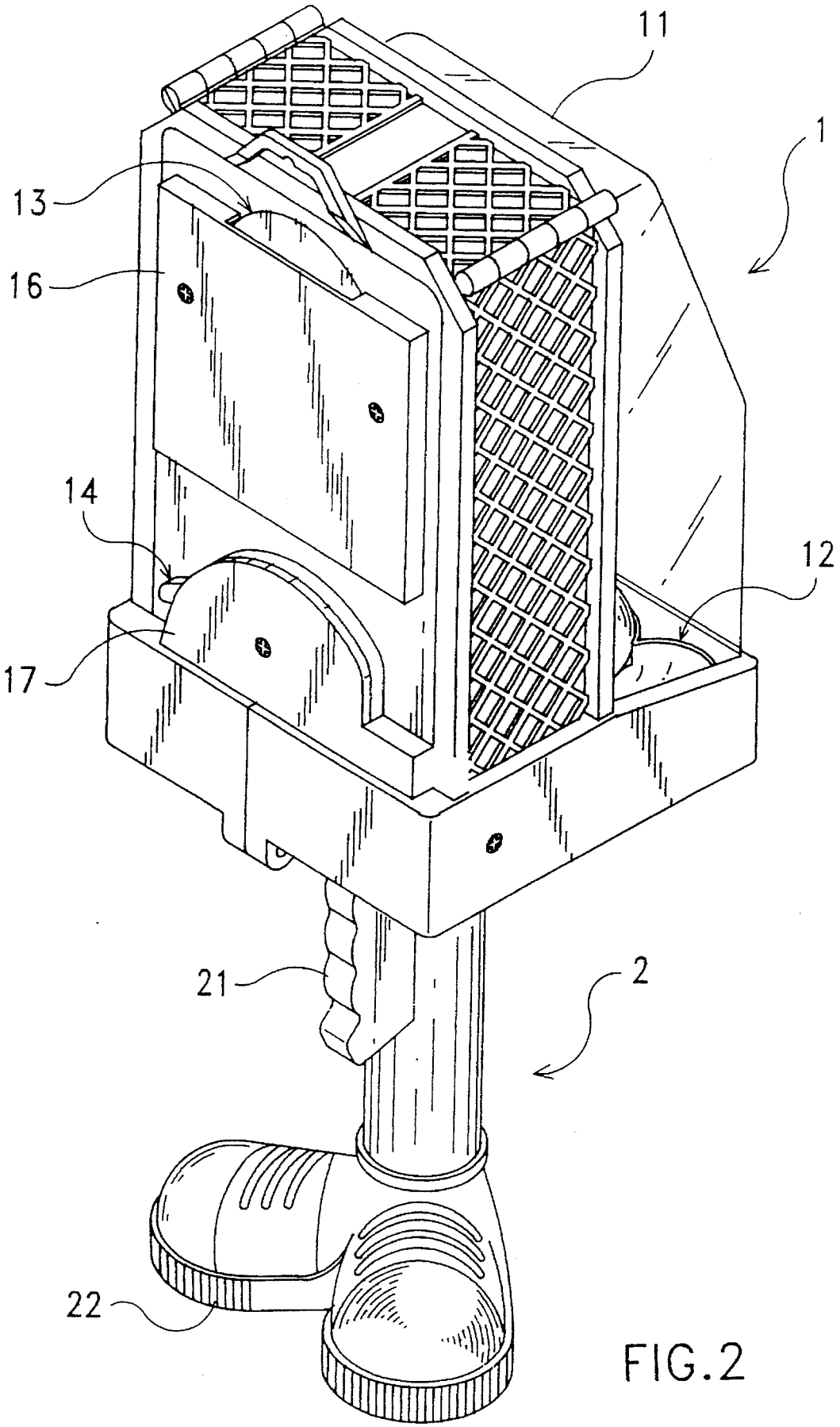
FIG. 2 is a back elevational view of the hand-held ball game toy shown in FIG. 1.
Figure 3:
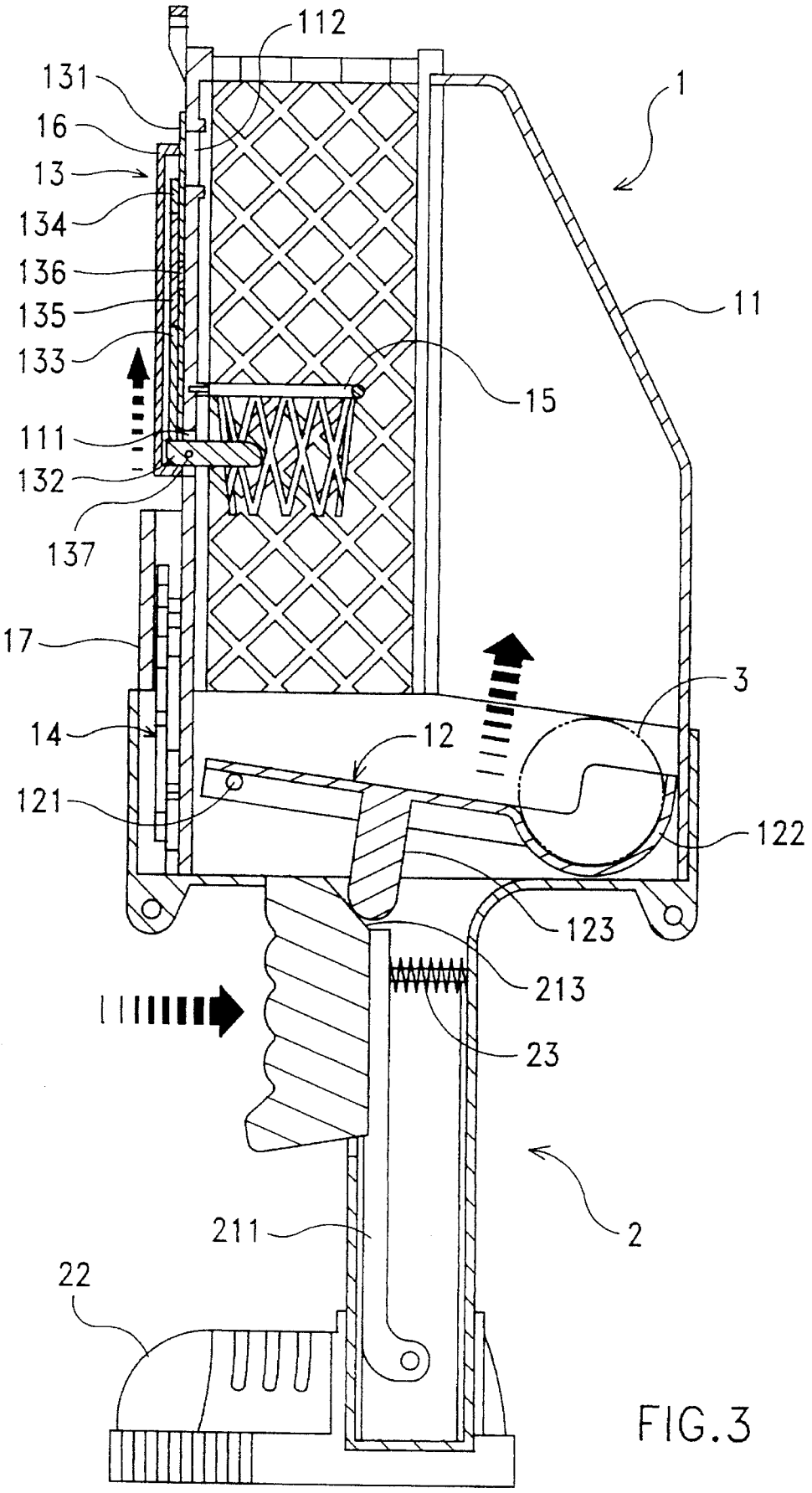
FIG. 3 is a side view in section of the hand-held ball game toy shown in FIG. 1.

Referring to FIGS. 1, 2, and 3, the mainframe 1 is supported on the column upright stanchion 2. The column upright stanchion 2 is supported on a base 22, which may be made of any of a variety of shapes for supporting the hand-held ball game toy on a flat surface. A trigger 21 is mounted on the column upright stanchion 2 at one side. The mainframe 1 comprises a shell 11, which is preferably transparent, a serving unit 12, a scoring unit 13, a shot timer unit 14, and a goal 15. The goal 15 shown in FIGS. 2 and 3 is a rim hoop ring with a net for playing the gape of basketball. However, it may be variously embodied according to the game to be played. For example: the goal shown in FIG. 1A is for the game of soccer or hockey; the goal shown in Figure 1B is for the game of football; the goal shown in FIG. 1C is for the game of baseball.

Referring to FIG. 1 and 3 again, the serving unit 12 is a flat plate having a pivot 121 transversely disposed at one end and mounted within the shell 11, a plurality of circularly recessed holes 122 transversely disposed at an opposite end, and a downward stop bar 123 at the bottom. The pivot 121 is spaced above the bottom of the mainframe 1 at a suitable distance. Therefore, the serving unit 12 is constantly disposed in a sloping position. The trigger 21 has a chamfered edge 213 at the top stopped against the downward stop bar 123 of the serving unit 12, and a back bar 211 turned about a pivot 212 inside the column upright stanchion 2 and supported on a spring 23. When the trigger 21 is depressed, the downward stop bar 123 is suddenly moved upwards, causing the serving unit 12 to eject a ball 3 from one circularly recessed hole 122 toward the goal 15.

Figure 4B:
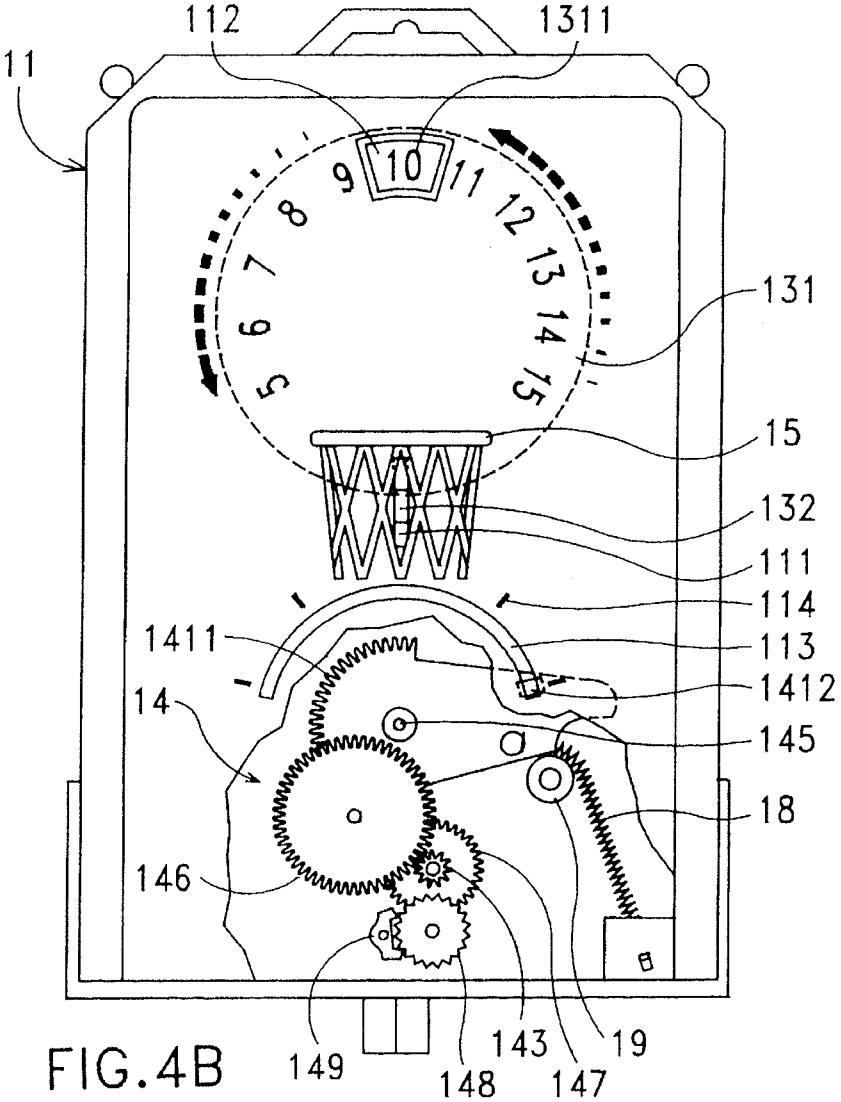
FIG. 4B is a front view in section of the main frame of the hand-held ball game toy shown in FIG. 1.
Figure 4A:
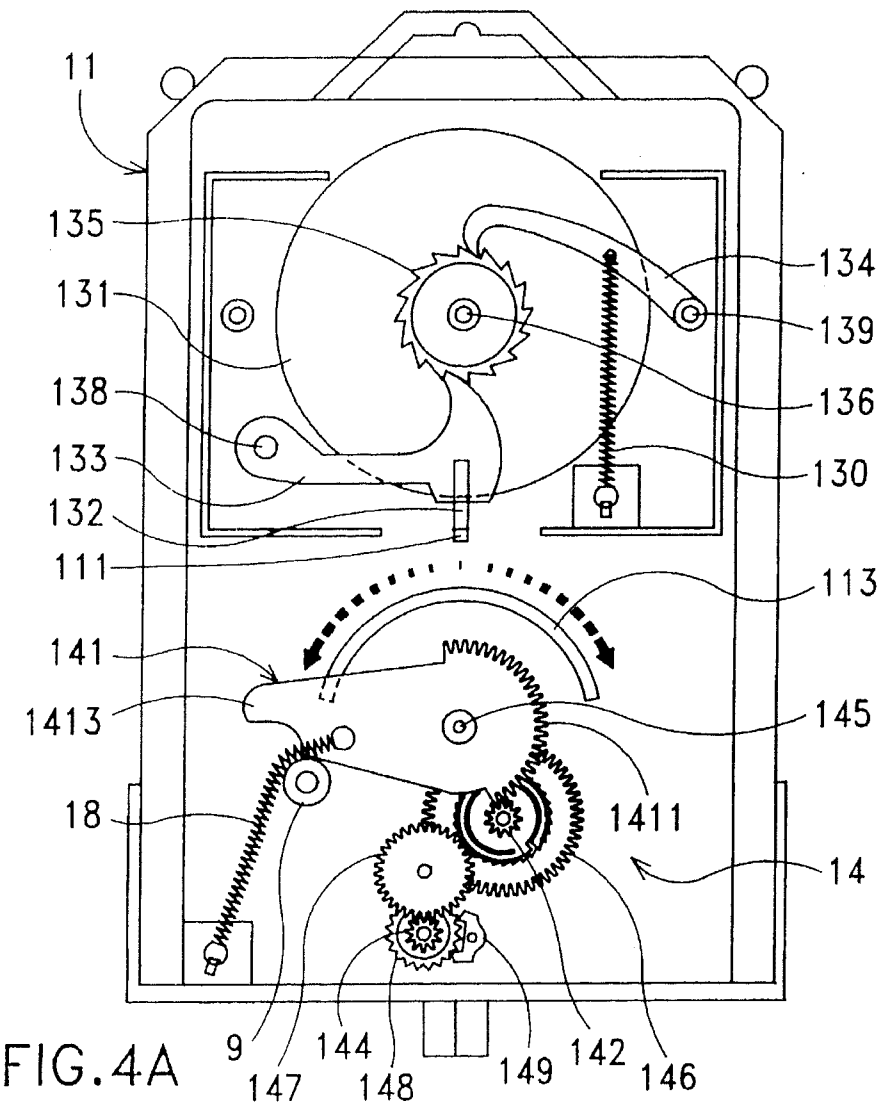
FIG. 4A is a back view in section of the main frame of the hand-held ball game toy shown in FIG. 1.

Referring to FIGS. 4A and 4B, and FIG. 3 again, the scoring unit 13 is mounted on the back side of the shell 11 and covered by a back cover 16, comprised of a scoring wheel 131, a rocker 132, a push arm 133, a pawl 134, and a ratchet 135 fixedly mounted around the wheel shaft 136 of the scoring wheel 131. The scoring wheel 131 partially extends out of the back cover 16, having a series of digits 1311 at one side spaced around the border. The shell 11 has a window 13 on the back side thereof at a location corresponding to the digits 1311. The rocker 132 is turned about a pivot 137 in an opening 111 on the shell 1, having one end projecting into the goal 15 and an opposite end stopped at the bottom of the push arm 133. The push arm 133 has one end turned about a pivot 138 on the shell 11 and an opposite end meshed with the ratchet 135. The pawl 134 is turned about a pivot 139 on the shell 11 and pulled by a spring 130 to mesh with the ratchet 135 and to stop the ratchet 135 from reverse rotation. When the ball 3 enters the goal 15, the rocker 132 is forced by the ball 3 to move the push arm 133, causing the push arm 133 to turn the ratchet 135 forwards, and therefore the scoring wheel 131 is turned through an angle equal to the pitch between two digits 1311 and, the player can bee the new score from the window 112. As the scoring wheel 131 partially extends out of the back cover 16, it can be turned manually to zero the reading.

Referring to FIGS. 4A and 4B again, the shot timer unit 14 is mounted on the shell 11 at the back and covered by a back cover 17, comprised of an actuating bar 141, a driving gear 142, a transmission gear 143, and a driven gear 144. The actuating bar 141 is turned about a pivot 145 on the shell 11, having a toothed portion 1411 at one end meshed with the driving gear 142, and an index portion 1413 at an opposite end extended out of the back cover 17. The bottom side of the actuating bar 141 is connected to a spring 18, which is fixed to the shell 11 at the bottom and guided by a pulley 19. The shell 11 has a circularly arched groove 113 at the back side below the goal 15 around the pivot 145, and graduations 114 along the circularly arched groove 13. The index portion 1413 of the actuating bar 141 defines an indication zone 1412 corresponding to the circularly arched groove 113 (the graduations 114). A second driving gear 146 is fixedly mounted around the gear shaft (not shown) of the driving gear 142 and meshed with the transmission gear 143. A second transmission gear 147 is fixedly mounted around the gear shaft (not shown) of the transmission gear 143 and meshed with the driven gear 144. An output gear 148 is fixedly mounted around the gear shaft (not shown) of the driven gear 144. A substantially U-shaped reed 149 is mounted-on the shell 11, having two opposite ends meshed with the output gear 148. When the index portion 1413 of the actuating bar 141 is turned along the circularly arched groove 113 to the desired graduation (namely, the desired length of time), the spring 18 will automatically pull the actuating bar 141 back to its former position (the zero reading position). During the backward movement of the actuating bar 141 to count down the time, the driving gear 142 is turned by the toothed portion 1411 of the actuating bar 141 to turn the driven gear 144 through the driving gear 142, the second driving gear 146, the transmission gear 143, and the second transmission gear 147, causing the output gear 148 to act against the two opposite ends of the reed 149, and therefore the reed 149 is vibrated to produce sound.

While only one embodiment of the present invention has been shown and described, it will be understood that various modifications and changes could be made without departing from the spirit and scope of the invention.

What is claimed is:

1. A hand-held ball game toy comprising:

a column upright stanchion for the holding of the hand;

a housing supported on said column upright stanchion, having a vertical back wall and a goal mounted on said vertical back wall;

trigger means mounted on said column upright stanchion;

a ball received inside said housing;

a serving unit mounted inside said housing below said goal and driven by said trigger means to eject said ball toward said goal;

a scoring unit mounted on said vertical back wall of said housing to score points, said scoring unit being driven by said ball to score a point when said ball is driven by said serving unit into said goal; and a shot timer unit mounted on said vertical back wall of said housing and controlled to count down a predetermined length of time.

2. The hand-held ball game toy of claim 1 wherein said housing is made from transparent material.

3. The hand-held ball game toy of claim 1 wherein said serving unit comprises a flat plate having one end turned about a transverse pivot inside said housing, an opposite end made with a plurality of circularly recessed holes for carrying said ball, and a downward stop bar supported on said trigger means.

4. The hand-held ball game toy of claim 1 wherein said scoring unit comprises a scoring wheel having a series of digits at a front side spaced around the border and a wheel shaft at a back side, a ratchet fixedly mounted around said wheel shaft of said scoring wheel, a push arm having one end turned about a pivot on said vertical back wall of said housing and an opposite end meshed with said ratchet, a rocker turned about a pivot in an opening on said vertical back wall of said housing and having one end projecting into said goal and an opposite end stopped at against a bottom end of said push arm, and a pawl turned about a pivot on said vertical back wall of said housing and meshed with said ratchet to stop it from reverse rotation.

5. The hand-held ball game toy of claim 1 wherein said shot timer unit comprises an actuating bar turned about a pivot on said vertical back wall of said housing and having a toothed portion at one end and an index portion at an opposite end, a circularly arched groove made on said vertical back wall of said housing, graduations marked along said circularly arched groove for measuring time, a spring having one end fixed to a bottom wall of said housing and an opposite end fixed to said actuating bar to pull said index portion of said actuating bar to the zero reading of said graduations, a pulley mounted on said vertical back wall of said housing to guide said spring, a first driving gear meshed with said toothed portion of said actuating bar having a gear shaft at the center, a second driving gear fixedly mounted around the gear shaft of said first driving gear, a first transmission gear meshed with said second driving gear, a driven gear, a second transmission gear meshed between said first transmission gear and said driven gear, an output gear meshed with said driven gear, and a reed mounted on the vertical back wall of said housing and driven by said output gear to produce sound.

* * * * *